United States Patent [19]

DeBliquy

[11] Patent Number: 4,606,669

[45] Date of Patent: Aug. 19, 1986

[54] CONNECTOR

[75] Inventor: Michael C. DeBliquy, Illovo, South Africa

[73] Assignee: Dymet Dymensions (Proprietary) Limited, Randburg, South Africa

[21] Appl. No.: 668,121

[22] Filed: Nov. 5, 1984

[30] Foreign Application Priority Data

Nov. 9, 1983 [ZA] South Africa ..... 83/8331

[51] Int. Cl.[4] ..... F16B 7/04

[52] U.S. Cl. ..... 403/170; 403/218

[58] Field of Search ..... 403/170, 171, 172, 175, 403/176, 169, 64, 174, 178, 218, 217, 56; 52/81, 82

[56] References Cited

U.S. PATENT DOCUMENTS 3,323,820 6/1967 Braccini ..... 52/81
4,244,152 1/1981 Harper, Jr. ..... 403/217
4,355,918 10/1982 Van Vliet ..... 403/373
4,461,284 7/1984 Fackler ..... 403/56
4,480,418 11/1984 Ventrella ..... 403/171

FOREIGN PATENT DOCUMENTS 1391973 2/1965 France ..... 403/176

*Primary Examiner*—Cornelius J. Husar
*Assistant Examiner*—Peter M. Cuomo

[57] ABSTRACT

A space frame connector which has two inner shells and two outer shells. Each outer shell is fixed to an inner shell with ends of structural members secured between the two shells. The four shells are fixed together with ends of structural members secured between the two inner shells, one being made of a first washer which is engaged with the two inner shells and a second washer which is engaged with the two outer shells.

6 Claims, 7 Drawing Figures

CONNECTOR

BACKGROUND OF THE INVENTION

This invention relates generally to spaceframe structures and more particularly to a connector suitable for use at a node point of such a structure.

There are a number of problems associated with the erection of spaceframe structures. In the first place the system adopted must lend itself to progressive assembly of the various modules over the area covered by the spaceframes. Manufacturing tolerances in the spaceframe components must be catered for so that the possibility of accummulated errors is minimized. In similar vein it should be possible to interchange components and, where necessary, to replace faulty chords or webs with relative ease. Another category of problem arises when the chord and web members are threadedly engaged with connectors at the nodal points. This is due to the fact that the threads have fine tolerances and, when use is made of unskilled labour, the threads can be stripped. Another difficulty is that considerable moments may be exerted on the connectors when the threaded members are tightened.

Various examples of such connectors are shown in the specifications of French Pat. Nos. 2136936, 2250395, and 2430535; U.S. Pat. No. 4,355,918; European Pat. No. 53582; and German Pat. No. 3019787.

SUMMARY OF THE INVENTION

It is an object of the present invention to provide an improved connector.

The invention provides a spaceframe connector which includes two inner shells, two outer shells which respectively at least partly overlie the inner shells, and means for securing the shells to each other, the inner shells including formations which are engageable with ends of elongate members, and at least one inner shell and an outer shell including formations which are engageable with ends of elongate members.

The formations on the inner shells may comprise depressions which are engageable with complemental formations on the ends of the elongate members.

The depressions may comprise hemispherical recesses.

The formations on the inner shells may oppose each other and may form enclosed sockets for ball-like formations on the ends of the elongate members.

Each inner shell may include two of the formations aligned so that the elongate members extend in line and in opposite directions from the shell.

Preferably each inner shell and a respective outer shell each include a plurality of recesses which respectively oppose one another when the shells are secured to each other.

The recesses preferably define sockets for ball-like formations on the ends of the elongate members.

Each outer shell may have a plurality of slots extending respectively to the sockets which permit the elongate members to be angularly adjusted relatively to the shell.

The sockets may be located at 120° from each other in plan and the elongate members may extend from the shell at angles of 60° relatively to each other.

Each outer shell may have an inner face which is slightly concave and an outer face which is slightly convex.

Each inner shell and respective outer shell may be secured to each other in any suitable way for example by means of a bolt.

The two pairs of inner and outer shells may also be secured to each other in any suitable way. In a preferred form of the invention use is made of a member which is located between the two opposing inner shells and fixing means which are engaged with the shells and the member.

The fixing means may include a first device which is engaged with the member and the two outer shells and a second device which is engaged with the member and the two inner shells.

The first and second devices may comprise conical or cup-shaped washers or collars through which the member passes.

BRIEF DESCRIPTION OF THE DRAWINGS

The invention is further described by way of example with reference to the accompanying drawings in which.

DESCRIPTION OF PREFERRED EMBODIMENT

Figure 1:
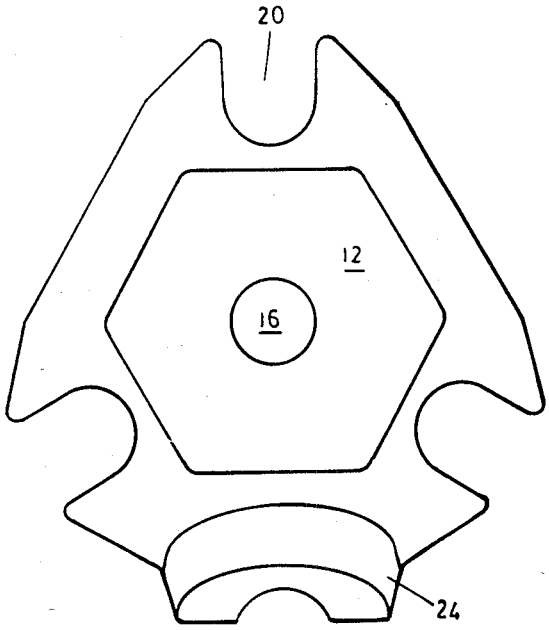
FIG. 1 is a view of the outer side of an outer shell used in the connector of the invention.
Figure 2:
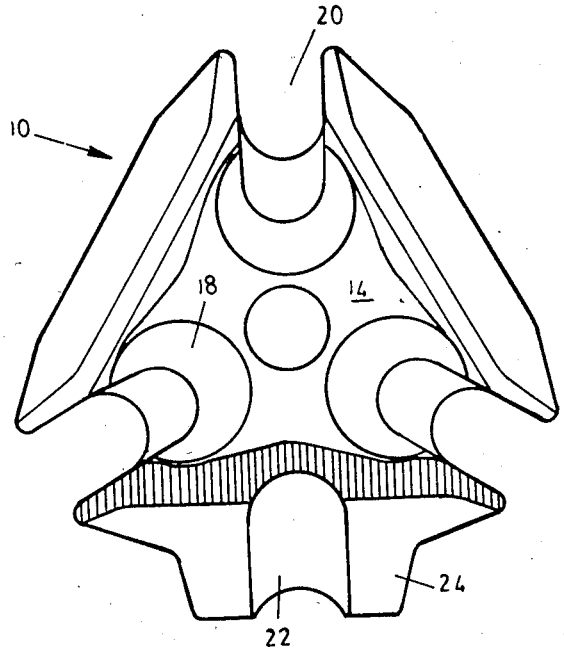
FIG. 2 is a view of the outer shell showing its inner face, FIGS. 3 and 4 respectively illustrate in the same way an inner shell used in the connector of the invention.

FIGS. 1 and 2 illustrate an outer shell 10 used in the connector of the invention. The outer shell has a slightly convex or outwardly extending outer face 12 and a slightly concave or recessed inner face 14. A hole 16 is formed centrally through the shell.

The inner face 14 has three hemispherical recesses 18 formed in it around the hole 16. Slots 20 are formed respectively into the recesses at angles in plan of 120° to each other.

The shell 10 has a depression 22 formed in its periphery and this is surrounded by half a collar 24 the outer surface of which is conical.

Figure 4:
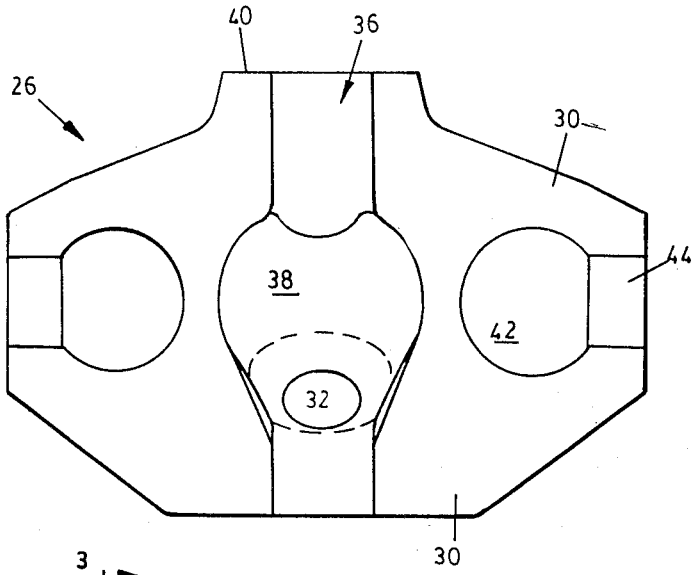
Figure 3:
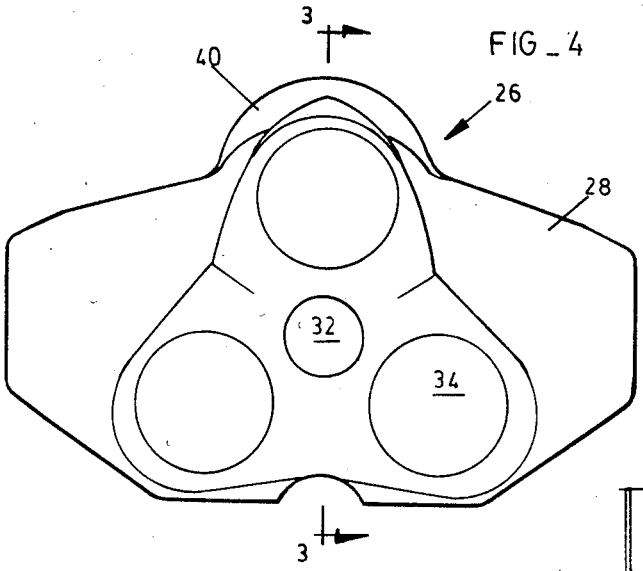
Figure 5:
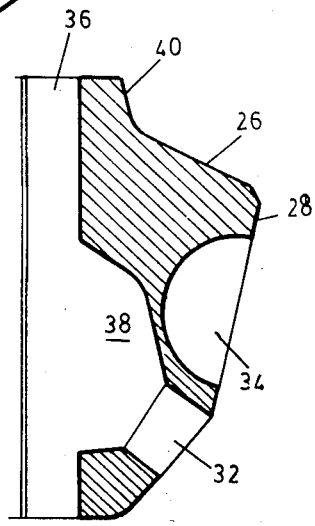
FIG. 5 is a cross-sectional view of the shell of FIGS. 3 and 4, taken on the line 3—3 of FIG. 3.

FIGS. 3, 4 and 5 illustrate an inner shell 26 which includes an outer face 28 and an inner face 30. A hole 32 is formed through the shell. Hemispherical recesses 34 are formed in the outer face 28 substantially symmetrically around the hole 32.

The inner face 30 has an elongate depression 36 formed in it. Where this depression crosses the hole 32 it is enlarged to form a hemispherical recess 38. Half a collar 40 is formed on the periphery of the shell around the depression 36. The outer surface of the half collar is substantially conical.

The inner face 30 has two hemispherical recesses 42 formed in it on either side of the elongate depression 36. Grooves 44 which are in line lead in to the recesses 42 respectively from opposite sides.

Figure 6:
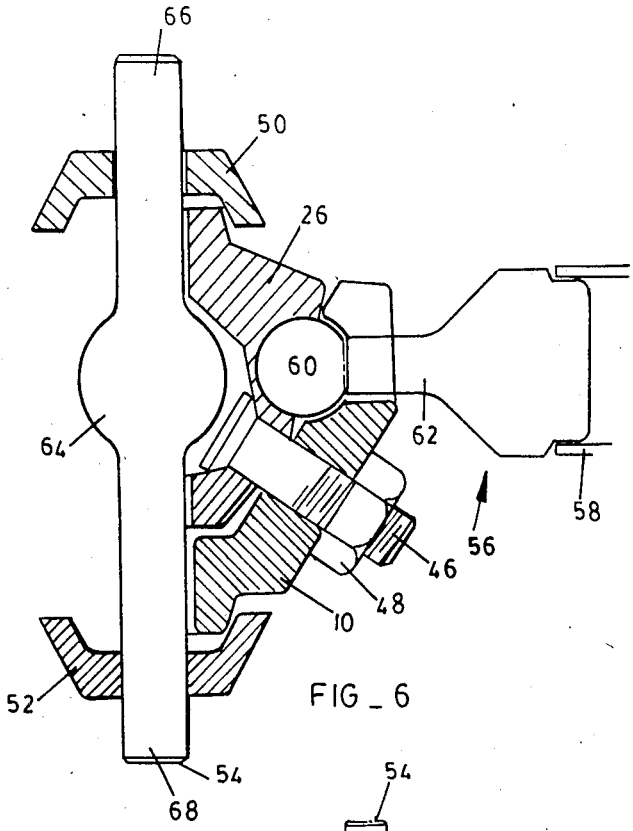
FIG. 6 illustrates in cross-section a portion of an assembled connector according to the invention.

In assembling a connector according to the invention use is made of two outer shells 10, two inner shells 26, and, as shown in FIG. 6, two bolts 46, two nuts 48, two cone or cup-shaped washers 50 and 52 respectively and a locating pin 54. FIG. 6 illustrates portion of a connector according to the invention partly sectioned. It also illustrates one end of a chord 56, i.e. a structural member, which is engaged with the connector. The chord includes an elongate tube 58 with a ball 60 extending from a neck 62 which is secured to an end of the tube 58. The webs i.e. the transverse members used in the frame structure have a similar construction.

An outer shell 10 and an inner shell 26 are designed to mate with each other as shown in FIG. 6. When these components are correctly orientated relatively to each other the recesses 18 in the inner face 14 in the outer shell 10 oppose the recesses 34 in the outer face 28 of the inner shell 26. The opposing sets of recesses form sockets or spherical cavities which are designed to receive the balls 60 of the web members.

Initially the necks 62 of the web members are passed through the slots 20 in the outer shell so that the balls 60 nestle in the recesses 18. The outer shell is then coupled to an inner shell so that the balls are contained within the spherical sockets. The bolt 46 is passed through the registering holes 16 and 32 and the nut 48 is engaged with the bolt to secure the two shells to each other. A second pair of inner and outer shells is assembled with web members in the same manner. The two pairs of shells are then mated to each other with the aid of the locating pin 54. This pin includes a bulbous central portion 64 which fits neatly into the enlarge hemispherical recesses 38 in the inner faces of the two inner shells. In this way the two sets of components are correctly aligned with each other. The pin has a first threaded shank 66 which extends from the bulbous portion and a second threaded shank 68 which extends in the opposite direction from the bulbous portion. The shank 68 lies in the depressions 22 of the outer shells.

When the two sets of shells are engaged with the locating pin 54 the inner faces 30 of the two inner shells mate and the recesses 42 form sockets which receive the balls 60 of two chord members respectively. The necks 62 then lie in the grooves 44 of the two inner shells. The cone washer 50 is passed along the shank 66 so that it nestles over the conical collar formed by the two half collars 40 of the two inner shells. Similarly the cone washer 52 is passed along the shank 68 and fits over the collar formed by the two half collars 24 of the two outer shells. Nuts threaded onto the two shanks respectively then secure the cone washers in position and at the same time secure the two pairs of shells to each other.

The embodiment of the connector assembly of the invention described herein is designed particularly for the construction of spaceframes based on tetrahedral modules. The outer shells 10 of the connector respectively couple together two sets of three structural members of adjacent tetrahedral modules while the inner shells couple together two chord members.

The shells of the connector may be made in any suitable manner but preferably are made in a forging process. This enables high volume high precision manufacture of the shells and minimizes the need for skilled workmen in the production process. Since the chord and web members are not threaded the balls of the members are easily located in the sockets of the shells. Alignment problems are minimized by the use of ball and socket connections which enable the structural members to be angularly adjusted relative to the shells. The ball and socket connections also minimize the application of moments to the shells during construction of the spaceframe structure. It is in addition particularly easy to replace the chord members which are engaged with the recesses 42 of the inner shells. The cone washers 50 and 52 are disengaged from the shells so that the two inner shells can be parted and the defective chord member is then extracted from the connector.

Figure 7:
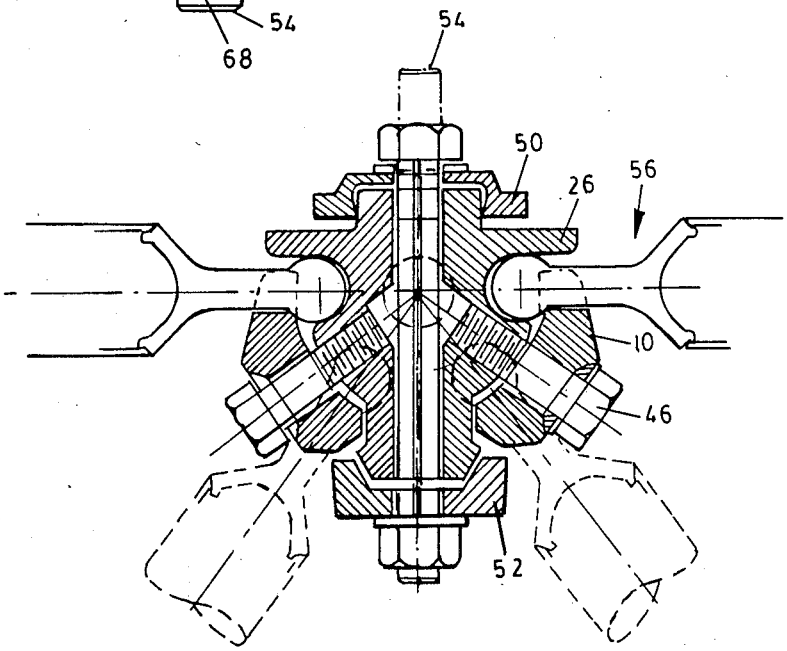
FIG. 7 illustrates in cross-section an assembled connector according to a second form of the invention.

The washers 50 and 52 need not be conical in shape for differently shaped cup washers could be used in their stead. It is also not essential for the pin 54 to have the particular illustrated shape for it can be replaced by a conventional bolt. Another variation involves the replacement of each pair of bolt and nut 46 and 48 respectively by means of a single bolt 46 which is threadedly engaged with the respective hole 32, in the inner shell, which is correspondingly tapped. Variations of this kind are shown in FIG. 7 wherein like components are marked with similar reference numerals to those used in FIGS. 1 to 6.

I claim:

1. A space frame connector which includes two inner shells, two outer shells which respectively at least overlie the inner shells, and means for securing the shells to each other with the inner shells opposing each other, the inner shells having opposing faces respectively in which are formed opposing depressions, each pair of opposing depressions forming a socket which is engageable with a complemental formation on an end of a respective elongate member, and at least one inner shell and an outer shell including formations which are engageable with ends of elongate members.

2. A connector according to claim 1 in which each inner shell and its respective outer shell are secured to each other, and in which the two pairs of inner and outer shells are secured to each other.

3. A connector according to claim 2 in which the securing means comprises means for securing the two pairs of inner and outer shells to each other which includes a member which is located between the opposing inner shells, a first device which is engaged with the member and the two outer shells, and a second device which is engaged with the member and the two inner shells.

4. A connector according to claim 3 in which the first and second devices respectively comprise cup-shaped washers through which the member passes.

5. A connector according to claim 1 wherein each inner shell and a respective outer shell include a plurality of recesses which respectively oppose one another.

6. A spaceframe connector which includes two inner shells and two outer shells, first means for securing the two inner shells to the two outer shells respectively, each inner shell and its respective outer shell including first opposing formations which are engageable with ends of elongate members, and second means for securing the four shells to each other with the two inner shells opposing each other, the second securing means including a first fixing device which is engageable with the two outer shells, a second fixing device which is engageable with the two inner shells, and a member which is engageable with the first and second fixing devices, the two inner shells including second opposing formations which are engageable with ends of elongate members.

* * * * *